United States Patent [19]

Salomon

[11] 3,942,811

[45] Mar. 9, 1976

[54] SAFETY BINDING

[75] Inventor: George Piérre Joseph Salomon, Annecy, France

[73] Assignee: Etablissements Francois Salomon et Fils, Annecy, France

[22] Filed: Mar. 6, 1975

[21] Appl. No.: 555,866

[30] Foreign Application Priority Data

Mar. 6, 1974 France ..... 74.07643

[52] U.S. Cl. ..... 280/11.35 T

[51] Int. Cl.[2] ..... A63C 9/08

[58] Field of Search ..... 280/11.35 T, 11.35 M

[56] References Cited

UNITED STATES PATENTS

| | | | |
|---|---|---|---|
| 3,537,719 | 11/1970 | Gottfried | 280/11.35 T |
| 3,630,538 | 12/1971 | Klein | 280/11.35 T |
| 3,716,248 | 2/1973 | Wiley | 280/11.35 T |

*Primary Examiner*—Robert R. Song

[57] ABSTRACT

The invention relates to a safety binding providing automatic recentering of the boot on the longitudinal axis of the ski and comprises a retaining element for one end of the boot, the element consisting of a catch cooperating with a slope and adapted to move, in relation to the ski, between two positions. The end of the boot also comprises, above the slope which cooperates with the catch, a sliding surface pointing in a downward direction and also cooperating with the catch when the latter rocks from the first to the second position. The binding allows the skier to put his skis on while he is standing up and without having to look at the boots.

14 Claims, 13 Drawing Figures

SAFETY BINDING

The present invention relates to a safety binding for a ski boot, more particularly to a binding and a boot providing automatic recentering of the boot on the longitudinal axis of the ski when the binding is fitted to the boot with the skier standing upright.

Bindings comprising an element retaining one end of the boot, and having a catch cooperating with a slope located at the end of the boot are already known. This catch is adapted to move, in relation to the ski, between two positions:

a first position, known as the boot-removed position, in which the catch is lifted away from the ski, so that the skier may remove the boot from the binding;

a second position, known as the boot-fitted position, in which the catch is lowered towards the ski and cooperates with a slope located on the boot in such a manner that the boot is held to the ski.

Such binding is described in applicant's co-pending application U.S. Ser. No. 374,623 filed June 28, 1973.

Although bindings of this kind ensure perfect centering of the boot on the longitudinal axis of the ski when the boot is in position, they do not completely solve the problem of automatically centering the boot when the ski is being put on, since the skier does not always place his boot on the longitudinal axis of the ski, either because it does not occur to him or because he is in no position to verify conveniently whether the boot is aligned with the longitudinal axis of the ski. With bindings of this kind, therefore, the skier will have some difficulty in locking his binding, and he will have to "fumble about" in order to find the position of the boot in which the retaining element pivots (either automatically or manually) into the locked position.

It is an object of the invention to solve this problem by providing a binding which will automatically centre the boot on the longitudinal axis of the ski when the ski is fitted by a skier standing upright. With a binding of this kind, even if the skier places the boot across the ski, it will automatically be brought back to the longitudinal axis of the ski, with no need for the skier to check (visually or otherwise) the movement of his boot.

In order to achieve this result, an essential characteristic of the binding and the boot according to the invention is that the end of the boot also has a permanent sliding surface above the slope which cooperates with the catch, the sliding surface being downwardly oriented, i.e. facing in a downward direction. This sliding surface also cooperates with the mobile catch when the catch pivots from the first to the second position, thus centering the boot on the longitudinal axis of the ski. This is achieved by imparting to the sliding surface a shape corresponding to that of the catch, so that the latter becomes partially embedded therein. According to the invention, the sliding surface located on the boot is a symmetrical surface having as its plane of symmetry the longitudinal plane of symmetry of the ski.

According to another characteristic of the invention, the profile of the sliding surface integral with the boot, as seen in section through transverse sloping planes, is a curve opening out towards the same end of the boot. The opening angle of this curve preferably varies continuously as a function of the angle of inclination of the planes of section. According to variations in the design, this opening angle may increase or decrease as a function of the angle of inclination. Preferably, however, the sliding surface is such that the opening angle increases when the angle of inclination in relation to the plane of the sole increases. Furthermore, when the boot is in position, the profile of the sliding surface may be complementary to the profile of the corresponding part of the catch with which the sliding surface engages.

In other forms of execution, and according to a complementary characteristic of the invention, the mobile catch comprises at least one projecting part cooperating with the downwardly oriented sliding surface when the catch pivots from the first to the second position, at least one of the projecting parts of the catch sliding on the downwardly oriented surface. In one preferred form of embodiment of this variant, the sliding surface also comprises, on each side, a substantially flat sloping surface, also downwardly oriented, upon which the projecting parts of the catch slide.

In other forms of execution, and according to a complementary characteristic of the invention, the catch also comprises, above the slope cooperating with the boot when the boot is in position, an upwardly oriented sliding surface. This upwardly oriented sliding surface is preferably symmetrical, having for its plane of symmetry the longitudinal plane of symmetry of the ski. Also preferably, the profile of the sliding surface integral with the catch, as seen in section through sloping transverse planes, is a curve opening out towards the same end of the boot. As previously indicated, the opening angle of this curve may increase or decrease as a function of the angle of inclination of the planes of section.

Similarly, with the boot in place, the profiles of the contacting surfaces, integral respectively with the catch and the boot, may be complementary, so that, with the boot in place, the boot engages with the corresponding part of the catch.

In certain forms of execution of this latter variant, and according to another complementary characteristic of the invention, the end of the boot also comprises a projecting portion, preferably located in the plane of symmetry of the binding, so that the projecting portion of the boot helps to guide the boot towards the longitudinal axis of the ski. Where the sliding surface integral with the boot has a V-shaped profile, the projecting portion is the apex of the V. But it is not essential to the correct operation of the automatic centering device according to the invention for the sliding surface integral with the boot to have a projecting portion. In other words, it is not essential for the contact between the end of the boot and the surface integral with the catch to be located on a projecting part; in fact, as already indicated, in certain design variants, this contact may first of all be made, when the skier starts to put the ski on,, by the projecting parts of the catch, and then as the catch pivots, the two sliding surfaces integral respectively with the catch and the boot may come into contact. When the attachment of the ski has been completed, these sliding surfaces engage one within the other. The projecting parts of the catch are preferably arranged symmetrically in relation to the longitudinal plane of symmetry of the catch. Where the catch has a M-shaped profile, the projecting parts are preferably the lateral points located on each side of the M-shaped profile.

In the case where the stop remote from the retaining element is such that the boot is displaced longitudinally in relation to the ski against the action of a spring, in the event of a fall involving vertical release of the safety binding (especially in the case of the binding described in U.S. Pat. application No. 358,329, filed on May 8th, 1973, in the name of Georges, Pierre, Joseph SALOMON), and according to a complementary characteristic of the invention, the catch or the boot furthermore comprises a longitudinal recess in which the sliding surface integral, respectively, with the boot or the catch engages when the boot is in the fitted position. This arrangement makes is impossible for the boot to move laterally until it is completely free of the catch; permanent lateral retention is thus assured. The depth of this recess, however, must be limited so that it does not prevent the boot from rotating when the stop is released under lateral stress.

By way of a new product, the invention also relates to a ski boot comprising retaining slopes and sliding surfaces designed to recentre the boot in the binding in accordance with the foregoing.

A description will now be given of a few design variants, not intended to be in any way restrictive, in conjunction with the drawings, wherein.

Figure 11:
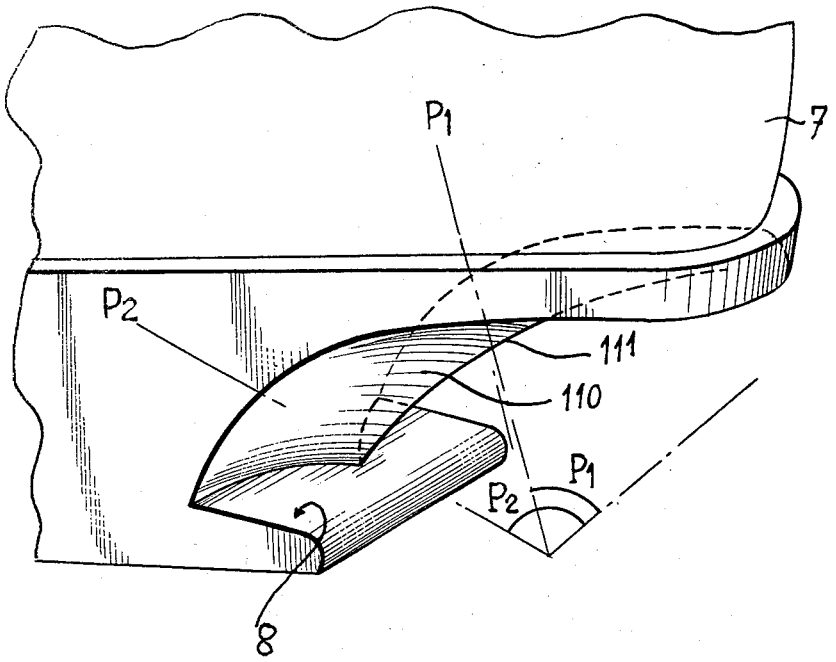
FIG. 11 is a perspective view, from the rear, of a boot according to the invention, the boot comprising a sliding surface broken in the longitudinal plane of symmetry of the boot.
Figure 12A:
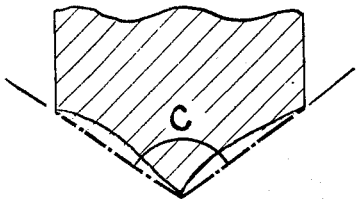
Figure 12B:
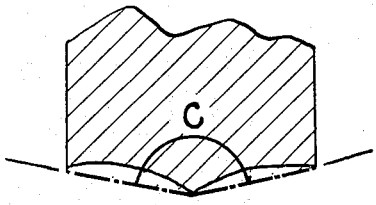

FIGS. 12*a*, 12*b* are two details, in section through two transverse planes inclined at different angles, of a variant of the sliding surface of the boot shown in FIG. 11.

Figure 1:
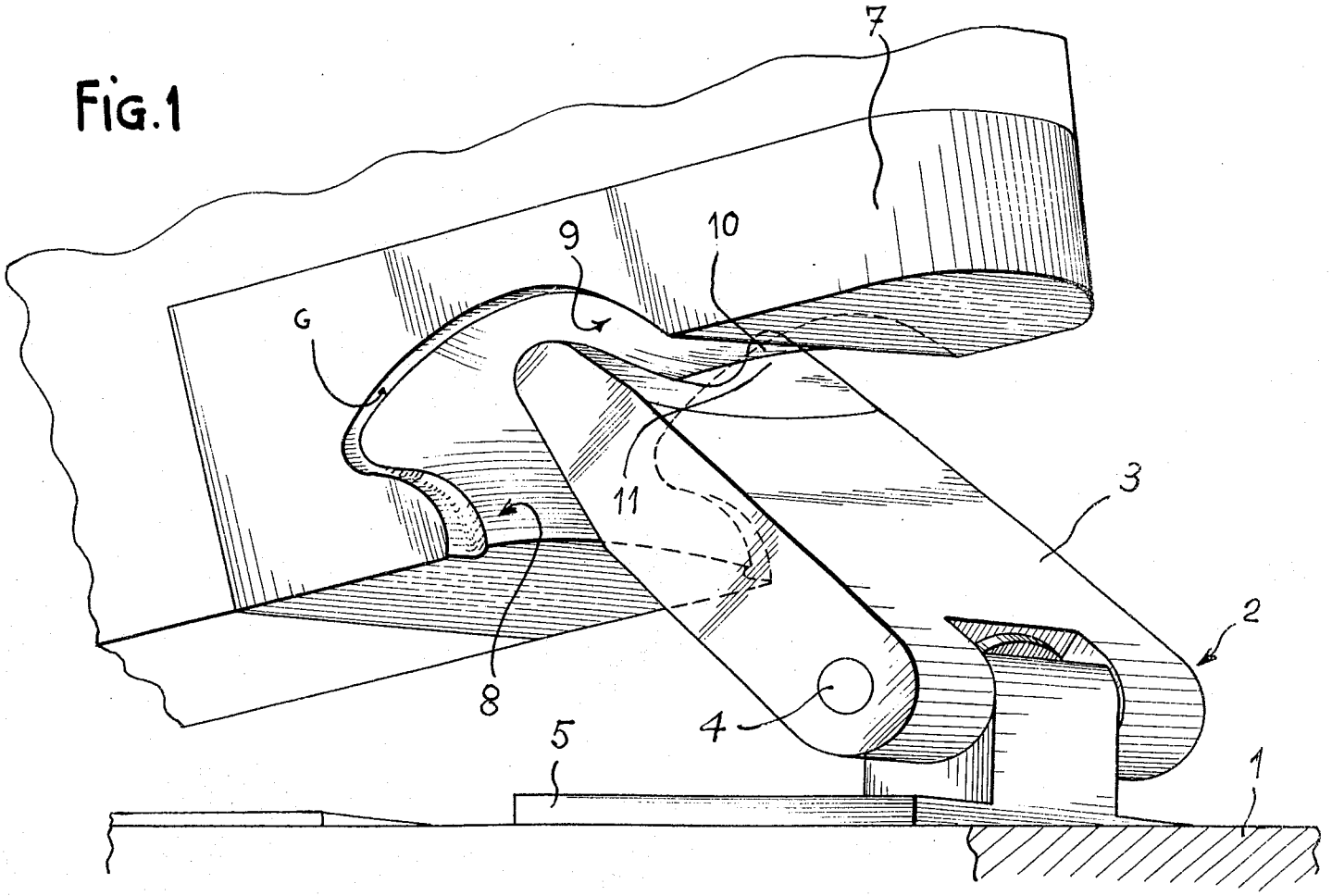
FIG. 1 is a broken-away perspective view, from below and to one side, of the heel of skier's boot engaging with the binding according to the invention, with the sliding surfaces integral with the boot resting upon the sliding surface of the mobile catch, the latter being shown in the raised position, and the boot being located across the ski.

A description will now be given of FIG. 1, which is a perspective view from below, and to one side, of the heel of the skier's boot engaging with the binding according to the invention.

Mounted on ski 1 is a heel-piece 2 comprising a mobile catch 3 adapted to rotate about an axis 4 integral with a baseplate 5 attached to the ski, more particularly by means of screws, not shown. Catch 3 is designed to retain rear end 7 of the boot by means of a downwardly oriented system of slopes 30, under which an upwardly-oriented slope 8 at the rear end of the boot engages when the boot is in the fitted position (shown in FIG. 3).

A stop, not shown, designed to retain the front end of the boot, is mounted farther forward on the ski. This stop may be arranged to release laterally under an abnormally high lateral torque.

In certain variants, the catch is designed to release and lift under an abnormally high vertical stress; this applies in particular to the stop described in French Pat. No. 1,341,417 filed on Dec. 27th, 1962, in respect of a safety binding for skis.

In other variants, the catch is locked to the ski, and it is the front stop which allows the boot to be released from the heel-piece by moving forwards; this applies in particular to the catch described in Application 374,623 filed in U.S. on June 28, 1973.

Regardless of the design of the catch or the stop, the present system of automatic recentering according to the invention may be used whenever the mobile catch is in a raised position when the ski is being put on.

The automatic recentering system according to the invention consists of a sliding surface 9 integral with the boot and located above locking slip 8. This sliding surface 9 is a downwardly oriented symmetrical surface, the sections of which, through planes parallel with the plane of the boot, are curves in the variant illustrated in FIG. 1:

the concave curves being located in the upper portion opening towards each side of the boot, the convex curves being located in the lower portion, in the vicinity of the locking slope opening towards the front of the boot.

In order to put his skis on, the skier engages the front end of his boot with the front stop, and lifts the rear end up. He then presses sliding surface 9, located under the heel of his boot, on raised catch 3, causing the catch to pivot downwardly. During this movement, the end of the catch slides on the sliding surface of the boot in such a manner that even if the boot lies across the ski, it will automatically be centred on the longitudinal axis thereof.

Figure 4:
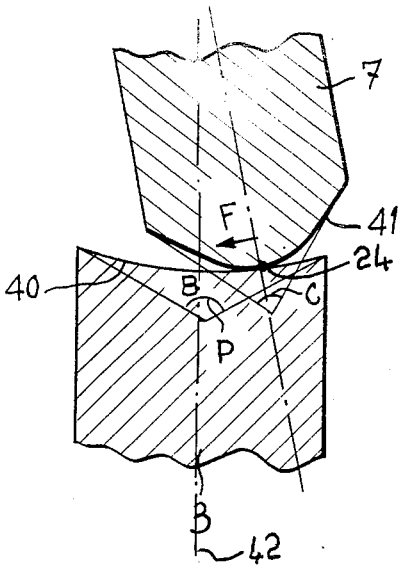
FIG. 4 is a detail of the profiles, in section through an inclined transverse plane *a—a* of the sliding surfaces integral respectively with the catch and the boot, in the position shown in FIG. 1.
Figure 6:
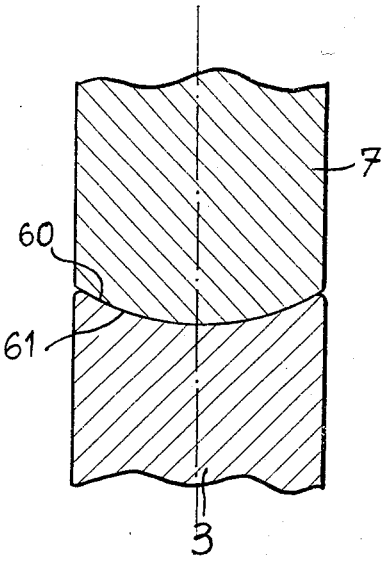
FIG. 6 is a detail of the profiles, in section and through a transverse plane *b—b*, of the sliding surfaces integral respectively with the boot and the catch, with the boot in the fitted position.
Figure 5:
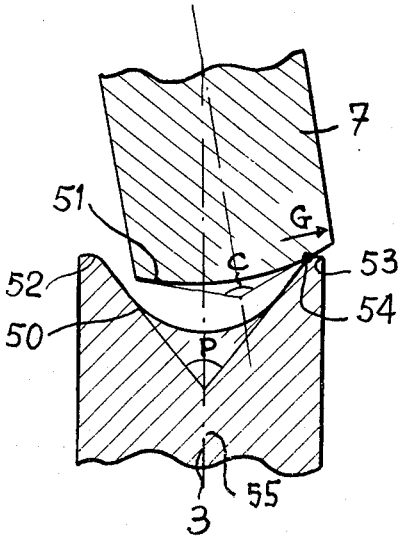
FIG. 5 is a detail of the profiles, in section through an inclined transverse plane *a—a*, of another design of the sliding surfaces integral respectively with the boot and the catch, in the position shown in FIG. 1.

FIGS. 4, 5, 6 show preferred profiles for the sliding surfaces integral respectively with the boot and the catch, as required in order to obtain this result. It will be observed, however, that in the variant illustrated in FIG. 1, arched portion 10 of the sliding surface integral with boot slides on upwardly oriented sliding surface 11 of the catch located above the slope on the catch which locks the boot to the ski. If the boot is already centred when the ski is being fitted, the lateral M-shaped ends of the catch slide in grooves G, and the boot can no longer be off-centered.

Figure 2:
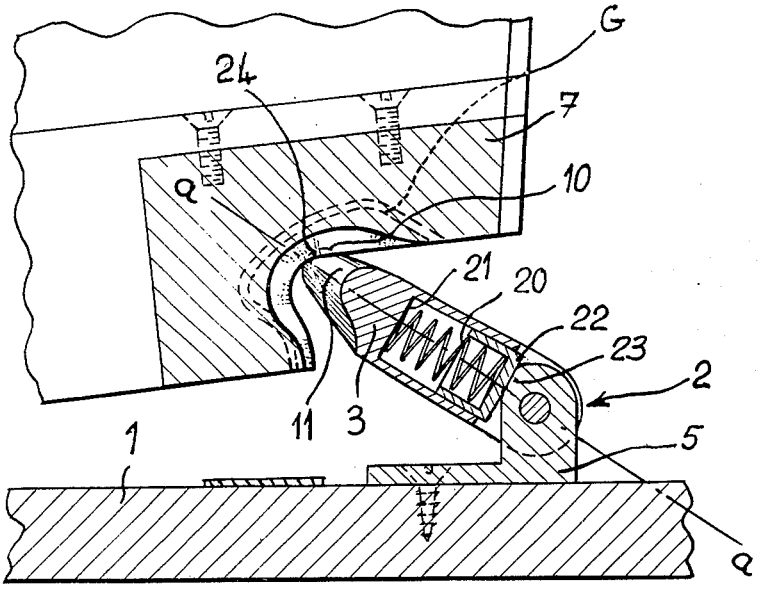
FIG. 2 is a detail, in longitudinal section and through the plane of symmetry of the ski, of the rear end of the binding and the boot, in the position shown in FIG. 1.

A description will now be given of FIG. 2, which is a detail, in longitudinal section through the plane of symmetry of the ski, of the rear end of the binding and the boot, in the position shown in FIG. 1 which shows ski 1, heel-piece 2, and the end of boot 7 partly engaged in the binding.

The heel-piece executes a safety release under the action of a vertical load in known fashion; the resilient locking system consisting of a spring 20, one end of which bears against the inside face of catch 21, while the other end bears, through a piston 22, against a flat 23 integral with baseplate 5. The arched portion 10 of the sliding surface integral with the boot (located substantially in the vicinity of the longitudinal plane of symmetry of the boot) bears at 24 against upwardly oriented sliding surface 11 integral with the catch. It will be observed that the contact area between these two surfaces is not in the longitudinal plane of symmetry of the ski, but, let it be remembered, the boot is not shown aligned with the longitudinal axis of the ski.

When catch 3 pivots under the action of the skier's heel, contact point 24 slides towards the lowest point on concave sliding surface 11 integral with the catch; this lowest point is located on the longitudinal plane of symmetry of the ski, so that the boot automatically tends to align itself along the longitudinal axis. It will be better realized, from the descriptions of FIGS. 4 and 6 hereinafter, that the sliding surface integral with the catch is in the form of a left-hand concave surface, the axis of symmetry of which is the longitudinal plane of symmetry of the ski.

Figure 3:
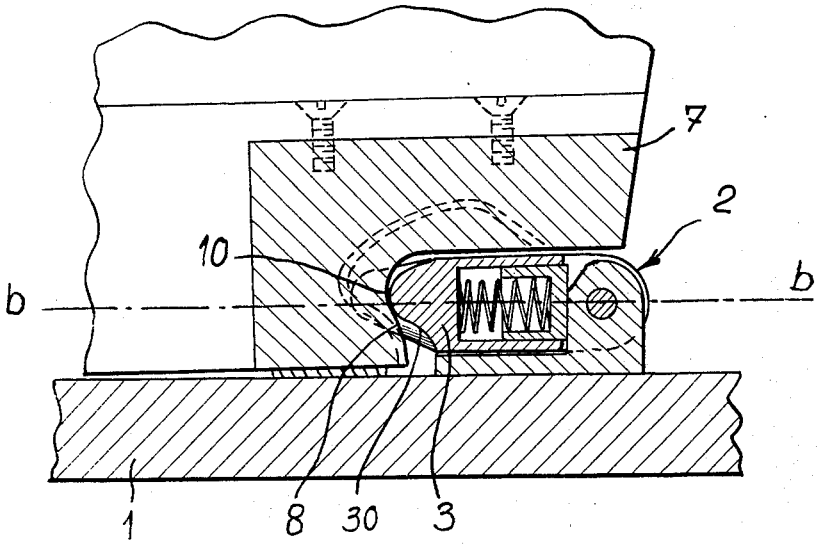
FIG. 3 is a detail, in longitudinal section and through the plane of symmetry of the ski, of the rear end of the binding and the boot, with the boot in the fitted position.

A description will now be given of FIG. 3 which is a detail, in longitudinal section through the plane of symmetry of the ski, of the rear end of the binding and the boot, with the boot in the fitted position.

This figure shows ski 1, heel-piece 2, and rear end 7 of the boot. Catch 3 is in the lowered position locked to the ski, and inclined slope 8, integral with the boot, is engaged under slope 30 integral with the catch. In this variant, let us remember, vertical safety is assured by the mobile catch which lifts under an abnormally high vertical load; the front stop may be fixed in relation to the ski, since there is no need for the boot to slide forward along the longitudinal axis of the ski in order to release itself from the catch. On the other hand, if the catch remains in the low position locked to the ski (as described in French Pat. application No. 374,623 mentioned above), the boot must of necessity escape towards the front or the catch must slide towards the rear, if the boot is to be released from the binding when the skier's leg is subjected to an abnormally high load.

Convex portion 10 of the sliding surface integral with the boot is partly engaged in the complementary concave portion of the sliding surface integral with the catch. The boot is correctly centered on the longitudinal axis of the ski.

A description will now be given of FIG. 4, which is a detail of the profiles, in section through an inclined transverse plane *a—a*, of the sliding surfaces integral respectively with the catch and the boot, in the position shown in FIG. 1. Profile 40 of catch 3 is concave and is open towards the front end of the boot; profile 41 of the sliding surface integral with the boot is convex, the shape thereof being substantially complementary with the profile of the catch. In this particular variant, the radius of curvature of the catch profile is longer than the radius of curvature corresponding to the boot; in a similar manner, opening angle P of the catch profile is larger than opening angle C of boot profile 41.

It will be observed that, in this case, it is the arched portion of the sliding surface of the boot, adjacent the axis of symmetry thereof, that slides on the sliding surface integral with the catch. Contact area 24 between the boot and the catch tends to slide automatically, under the skier's weight, towards lowermost portion B of profile 40 located in the longitudinal plane of symmetry in the direction of arrow F. This means that the boot will pivot about its front end and will centre itself automatically on longitudinal axis 42 of the ski when the catch pivots, and this will become easier and easier, since the intensity of the frictional forces between the bridge and the boot decreases substantially as the slope of the catch in relation to the ski decreases.

A description will now be given of FIG. 5, which is a detail of the profiles, in section through an inclined transverse plane *a—a*, of a variant of the sliding surfaces integral respectively with the boot and the catch, in the position shown in FIG. 1.

In this variant, M-shaped profile 50 of the bridge again has a concave portion open towards the front end of the boot, and profile 51 of the boot is again of a complementary convex shape. In this variant, however, the radius of curvature of the catch profile is shorter than the radius of curvature of the boot profile; in other words, opening angle P of the catch profile is smaller than opening angle C of the boot profile. The catch has projecting parts 2, 3 located on each side, in the shape of an M, at the lateral ends of the profile. It will be observed that, in this variant, at least one of the projecting parts is in contact at 54 with the sliding surface integral with the boot. This contact area 54 moves on the sliding surface of the boot in the direction of arrow G. This means that the boot will pivot about its front end and will be automatically centred on the longitudinal axis 55 of the ski.

A description will now be given of FIG. 6, which is a detail of the profiles, in section through a transverse plane *b—b*, of the sliding surfaces integral respectively with the boot and the catch, in the position shown in FIG. 3. It will be observed that when the boot is in the fitted position, profile 61 of the sliding surface of the catch is substantially superimposed on profile 60 of the sliding surface of the boot. In other words, the sliding surface of the boot is partly embedded in the sliding surface of the catch.

In the variant illustrated in FIG. 4, the radius of curvature (opening angle) of the sliding surface of the boot increases progressively and becomes substantially equal to that of the catch as the slope of the planes of transverse section decreases.

On the other hand, in the variant illustrated in FIG. 5, the radius of curvature (opening angle) of the sliding surface of the boot decreases progressively and becomes substantially equal to that of the catch as the slope of the planes of transverse section decreases.

Figure 7:
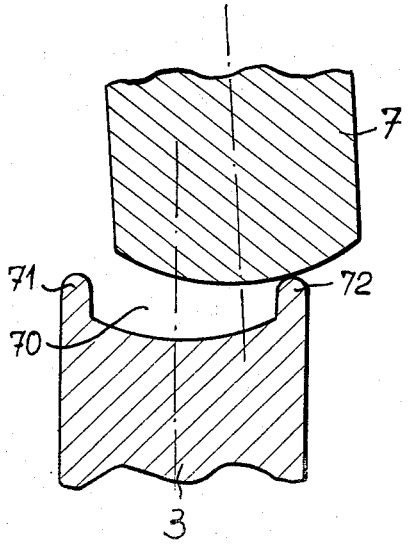
FIG. 7 is a detail of the profiles, in section through an inclined plane *a—a*, of another design of the sliding surfaces integral respectively with the boot and the catch, in the position shown in FIG. 1.
Figure 8:
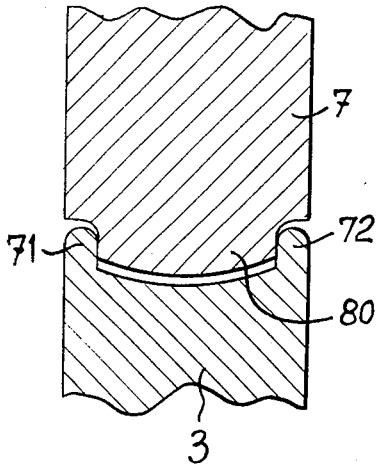
FIG. 8 is a detail of the profiles, in section through a transverse plane *a—a*, of the variant shown in FIG. 7 of the sliding surfaces, with the boot in the fitted position.
Figure 9:
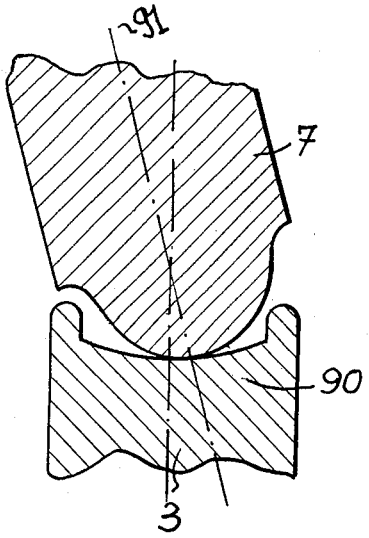
FIG. 9 is a detail of the profiles, in section through a transverse plane *a—a*, of the sliding surfaces of a variant other than that shown in FIG. 8, with the boot in the fitted position.

A description will now be given of FIGS. 7, 8 and 9 which illustrate:

on the one hand, a detail of the profiles, in section through an inclined plane *a—a*, of another variant of the sliding surfaces integral respectively with the boot and the catch;

on the other hand, a detail of the profiles, in section through a transverse plane *b—b*, of the preceding variant;

and finally, a detail of the profiles, in section through a transverse plane *a—a*, of a variant other than that illustrated in FIGS. 7 and 8.

In the case in which the catch remains locked in relation to the ski during the safety-release phase, and Best Available Copy in the case in which the front stop allows the boot to move longitudinally so that it releases itself from the locking slope on the catch, it is furthermore preferable to provide a system designed to retain the boot laterally, at least during the resilient travel.

In the variant illustrated in FIGS. 7 and 8, this lateral retention system consists of a recess 70 in the catch, in the form of two lateral wings 71, 72 extending longitudinally. Lower part 80 of the sliding surface integral with the boot engages, when the boot is fitted, between the lateral wings 71, 72 (FIG. 8), but contact between the boot and the catch occurs in the lateral areas only.

The method of operation of this recentering device is similar to that described in connection with FIG. 5; at least one of the projecting portions of the catch, more particularly part 72, comes up against the sliding surface integral with the boot, when the skier engages his boot in the binding (FIG. 7).

The depth of the recess (the length of lateral wings 71, 72) will preferably be equal to the length of the catch-release slope. However, the depth of the recess must be limited in order not to prevent rotation of the boot in the event of lateral release of the forward stop.

It is also possible to design this lateral-retention system for the case in which the recentering device operates as described in connection with FIG. 4. This applies more particularly to the variant illustrated in FIG. 9, in which contact point 90 between the sliding surfaces is in the vicinity of longitudinal plane of symmetry 91 of the boot.

The recess may conversely be applied to the boot, in which case the longitudinal and lateral extensions designed to retain the boot are located on the latter and, after recentering, it is the catch that engages in the recess.

Figure 10:
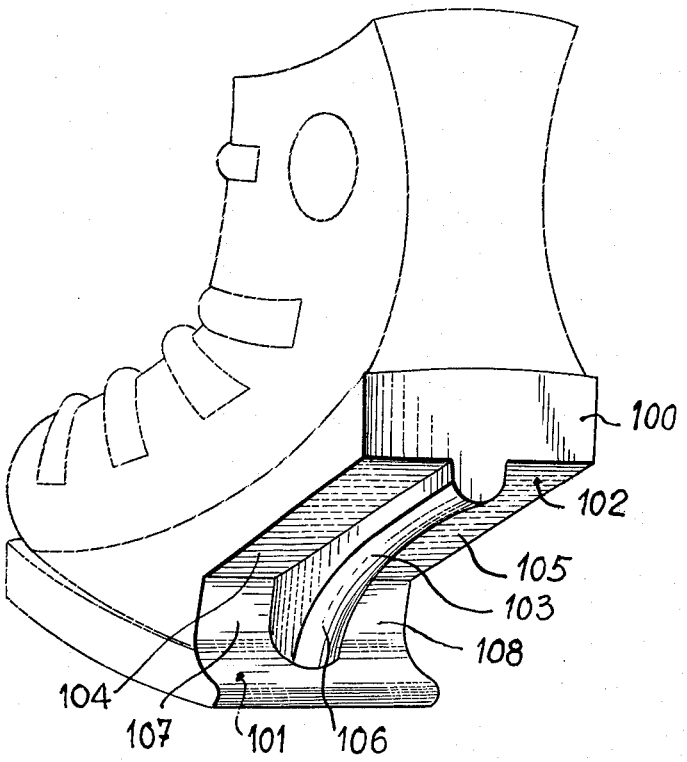
FIG. 10 is a perspective view, from the rear, of a variant of the boot according to the invention.

A description will now be given of FIG. 10 which is a perspective view of the rear of one variant of the boot according to the invention.

Seen in this figure, under the heel of boot 100, are locking slope 101 and downwardly oriented sliding surface 102 located thereabove. In this variant, the sliding surface comprises, on each side of a convex median part 108, two downwardly oriented, substantially flat parts 104, 105. The lower portion of sliding surface 106, designed to engage with the corresponding portion of the catch, has two lateral recesses 107, 108 for the accommodation of the lateral extensions integral with the catch, the purpose of which is to retain the boot laterally, as described in connection with FIGS. 7, 8, 9.

A description will now be given of FIGS. 11, 12*a* and 12*b* which illustrate:

on the one hand, a perspective view of the rear of a boot according to the invention, comprising a sliding surface which is broken along the longitudinal plane of symmetry of the boot;

on the other hand, two details 12*a*, 12*b* of the profiles, in section through two inclined transverse planes P2, P1 respectively, inclined at different angles, of the variant of the sliding surface on the boot illustrated in FIG. 11. In this variant, sliding surface 110 of boot 7 is always convex and symmetrical, like the catch; it consists of two surfaces joined together along the plane of symmetry of the boot and forming, in relation to each other, a more or less open angle.

It will be observed, with particular reference to FIGS. 12*a*, 12*b*, that, in this variant, opening angle C increases progressively as the angle of the transverse planes of section P1, P2 decreases in relation to the plane of the boot. It will also be observed that this variant comprises a sharp projecting edge 111 in the longitudinal plane of symmetry. This projecting portion 111 of the sliding surface of the boot will come into contact with the sliding surface of the catch for certain values of the radius of curvature, or of the opening angle, of the latter.

In all of the variants described above, the sliding surfaces integral with the boot and the catch are convex and concave respectively, but this could be otherwide - for instance they could be concave and convex; in this case, the catch would enter the boot when the boot was in the fitted position.

It will be observed on the other hand that, regardless of the particular variant, the profiles of these surfaces, in section through horizontal transverse planes in particular, are curves opening towards the same end of the boot, either towards the front or towards the rear.

What I claim is:

1. A safety binding providing automatic recentering of the boot on the longitudinal axis of the ski when the binding is fitted to the boot with the skier standing upright;

said binding comprising an element for retaining one end of the boot, said element comprising a catch cooperating with a slope located at the end of the boot and being mobile, in relation to the ski, between two positions:

a first boot-removed position, in which the catch is lifted away from the ski, so that the skier may remove his boot from the binding;

a second boot-fitted position, in which the catch is lowered towards the ski and cooperates with a slope located on the boot in such a manner that said boot is held to the ski;

said binding being characterized in that the end of the boot also has a permanent sliding surface located above the slope which cooperates with the catch, said sliding surface being downwardly oriented and also cooperating with the mobile catch when the latter pivots from said first to said second position, thus centering the boot on the longitudinal axis of the ski and becoming partly embedded in the boot.

2. A safety binding according to claim 1, characterized in that the sliding surface is a symmetrical surface, the plane of symmetry thereof being the longitudinal plane of symmetry of the boot.

3. A safety binding according to claim 2, characterized in that the profiles of the sliding surface integral with the boot, as seen in section through transverse planes inclined in relation to the plane of the boot, are curves opening towards the same end of the boot.

4. A safety binding according to claim 3, characterized in that the sliding surface of the boot comprises a substantially flat, sloping portion on each side, also downwardly oriented.

5. A safety binding according to claim 4, characterized in that the mobile catch comprises at least one projecting portion cooperating with the downwardly oriented sliding surface when said catch pivots from said first to said second position, one of said projecting portions of the catch sliding on the downwardly oriented sliding surface.

6. A safety binding according to claim 1, wherein the end of the catch comprises a slope cooperating with the boot in said boot-fitted position, said catch comprising, above said slope, a downwardly oriented sliding surface.

7. A safety binding according to claim 6, characterized in that the sliding surface integral with the catch is symmetrical, the plane of symmetry thereof being the longitudinal plane of symmetry of the ski.

8. A safety binding according to claim 7, characterized in that the profiles of the sliding surface integral with the catch, seen in section through inclined transverse planes, are curves opening towards the said same end of the boot.

9. A safety binding according to claim 8, characterized in that, in said boot-fitted position, the profiles of the sliding surfaces, seen in section through transverse planes passing through the points of contact between the sliding surface integral with the catch and the sliding surface integral with the boot, are substantially identical curves opening towards the same end of the boot.

10. A safety binding according to claim 9, characterized in that the end of the boot comprises a projecting portion, such that, when the catch pivots from the first to the second position, said projecting portion slides on the upwardly oriented sliding surface of the catch.

11. A safety binding according to claim 10, characterized in that the projecting portion of the slope of the boot is located in the plane of symmetry thereof.

12. A safety binding according to claim 2, said binding comprising a stop facing the retaining element, such that the boot moves longitudinally in relation to the ski, against the action of a resilient element, in the event of an accidental fall, said binding being characterized in that the catch also comprises a recess in which the lower end of the sliding surface of the boot engages, in the boot-fitted position, the length of said recess being substantially equal to the length of the release-slope on the boot, so that the latter cannot move laterally.

13. A binding according to claim 1, said binding comprising a stop, facing the retaining element, such that the boot moves longitudinally in relation to the ski, against the action of a resilient element, in the event of an accidental fall, said binding being characterized in that the boot also comprises a recess in which the sliding surface of the catch engages in the boot-fitted position, so that said boot cannot move laterally as long as it is engaged in the vertical releaseslope of the catch.

14. A safety binding according to claim 1, characterized in that the shape of the downwardly-oriented sliding surface is complementary to that of the catch.

* * * * *